US010418142B2

(12) United States Patent
Yoshida et al.

(10) Patent No.: US 10,418,142 B2
(45) Date of Patent: Sep. 17, 2019

(54) ALUMINUM ALLOY WIRE, ALUMINUM ALLOY STRANDED WIRE, COVERED ELECTRIC WIRE, AND WIRE HARNESS

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Sho Yoshida, Tokyo (JP); Kengo Mitose, Tokyo (JP); Shigeki Sekiya, Tokyo (JP)

(73) Assignees: FURUKAWA ELECTRIC CO., LTD., Tokyo (JP); FURUKAWA AUTOMOTIVE SYSTEMS INC., Shiga (JP)

( * ) Notice: Subject to any disclaimer, the term of this patent is extended or adjusted under 35 U.S.C. 154(b) by 0 days.

(21) Appl. No.: 16/236,744

(22) Filed: Dec. 31, 2018

(65) Prior Publication Data

US 2019/0139668 A1 May 9, 2019

Related U.S. Application Data

(63) Continuation of application No. PCT/JP2017/022495, filed on Jun. 19, 2017.

(30) Foreign Application Priority Data

Jul. 13, 2016 (JP) ..... 2016-138088

(51) Int. Cl.
*H01B 1/02* (2006.01)
*C22C 21/00* (2006.01)
(Continued)

(52) U.S. Cl.
CPC ..... *H01B 1/023* (2013.01); *B21C 1/02* (2013.01); *B22D 11/003* (2013.01); *C22C 21/00* (2013.01); *C22F 1/04* (2013.01); *H01R 4/18* (2013.01)

(58) Field of Classification Search
CPC ..... H01B 1/02; H01B 1/023; H01B 1/026; H01B 5/02; H01B 7/0045; C22C 21/08
(Continued)

(56) References Cited

U.S. PATENT DOCUMENTS

2011/0140517 A1 6/2011 Kusakari et al.
2012/0217060 A1 8/2012 Kusakari et al.
2013/0126051 A1* 5/2013 Sekiya ..... C22C 21/00 148/502
2013/0264115 A1* 10/2013 Kobayashi ..... H01B 1/023 174/72 A
2014/0020796 A1* 1/2014 Sekiya ..... H01B 1/023 148/550
(Continued)

FOREIGN PATENT DOCUMENTS

JP 2010-67591 A 3/2010
JP 5155464 B2 3/2013
(Continued)

OTHER PUBLICATIONS

International Search Report for PCT/JP2017/022495 dated Aug. 1, 2017.
(Continued)

*Primary Examiner* — William H. Mayo, III
(74) *Attorney, Agent, or Firm* — Birch, Stewart, Kolasch & Birch, LLP

(57) ABSTRACT

The present disclosure provides an aluminum alloy wire or the like which can secure a high conductivity and a moderately low yield strength, and realize both a high elongation and a moderate tensile strength.
(Continued)

An aluminum alloy wire of the present disclosure contains 0.10 to 1.00% by mass of Mg, 0.10 to 1.20% by mass of Si, 0.10 to 1.40% by mass of Fe, 0 to 0.10% by mass of Ti, 0 to 0.030% by mass of B, 0 to 1.00% by mass of Cu, 0 to 1.00% by mass of Mn, 0 to 1.00% by mass of Cr, 0 to 0.50% by mass of Zr, and 0 to 0.50% by mass of Ni, the balance being Al and 0.30% by mass or less of impurities. Coarse crystal grains are present in a vertical cross-sectional structure of the wire taken in a lengthwise direction of the wire. The greatest grain size of the coarse crystal grains as measured in the lengthwise direction of the wire is equal to or greater than a diameter of the wire. A proportion of an area of the coarse crystal grains to the total of the areas of all the crystal grains within a range of the vertical cross-sectional structure in which the vertical cross-sectional structure is measured, is 50% or more. Elongation of the wire is 10% or more.

20 Claims, 1 Drawing Sheet

(51) Int. Cl.

| | |
|---|---|
| ***B22D 11/00*** | (2006.01) |
| ***B21C 1/02*** | (2006.01) |
| ***C22F 1/04*** | (2006.01) |
| *H01R 4/18* | (2006.01) |

(58) Field of Classification Search
USPC ..... 174/126.1, 126.2
See application file for complete search history.

(56) References Cited

U.S. PATENT DOCUMENTS

| | | | | |
|---|---|---|---|---|
| 2014/0311769 | A1* | 10/2014 | In | C22C 5/06 174/126.2 |
| 2015/0235729 | A1* | 8/2015 | Yoshida | H01B 1/023 174/74 R |
| 2016/0358685 | A1* | 12/2016 | Yoshida | C22C 21/00 |
| 2017/0226615 | A1* | 8/2017 | Imasato | B21C 1/003 |
| 2017/0250000 | A1* | 8/2017 | Sekiya | B21C 1/02 |

FOREIGN PATENT DOCUMENTS

| | | | |
|---|---|---|---|
| JP | 2016-108612 | A | 6/2016 |
| JP | 2016-108617 | A | 6/2016 |
| JP | 2017-57423 | A | 3/2017 |
| WO | WO 2011/052644 | A1 | 5/2011 |

OTHER PUBLICATIONS

Written Opinion of the International Searching Authority for PCT/JP2017/022495 (PCT/ISA/237) dated Aug. 1, 2017.

International Preliminary Report on Patentability and English translation of the Written Opinion of the International Searching Authority(Forms PCT/IB/373 and PCT/ISA/237), dated Jan. 15, 2019, for International Application No. PCT/JP2017/022495.

* cited by examiner

ALUMINUM ALLOY WIRE, ALUMINUM ALLOY STRANDED WIRE, COVERED ELECTRIC WIRE, AND WIRE HARNESS

CROSS REFERENCE TO RELATED APPLICATIONS

This is a continuation application of international patent Application No. PCT/JP2017/022495 filed Jun. 19, 2017, which claims the benefit of Japanese Patent Application No. 2016-138088, filed Jul. 13, 2016, the full contents of both of which are hereby incorporated by reference in their entire

BACKGROUND

Technical Field

The present disclosure relates to an aluminum alloy wire used as a conductor of an electric wiring structure, an aluminum alloy stranded wire, a covered electric wire, a wire harness, and a method of manufacturing an aluminum alloy wire.

Background Art

In the related art, a so-called wire harness has been used as an electric wiring structure for transportation vehicles such as automobiles, trains, and aircraft, or an electric wiring structure for industrial robots and constructions or the like. The wire harness is a member including electric wires each having a conductor made of copper or copper alloy and fitted with terminals (connectors) made of copper or copper alloy (e.g., brass). With recent advancements in performances and functions of automobiles, various electrical devices and control devices or the like installed in vehicles tend to increase in number and electric wiring structures used for these devices also tend to increase in number. On the other hand, for environmental friendliness, lightweighting of transportation vehicles is strongly desired for improving fuel efficiency of transportation vehicles such as automobiles.

As one of the measures for achieving lightweighting of transportation vehicles, there have been, for example, continuous efforts in the studies of using aluminum or aluminum alloys as a conductor of an electric wiring structure, which is more lightweight, instead of conventionally used copper or copper alloys. Since aluminum has a specific gravity of about one-third of a specific gravity of copper and has a conductivity of about two-thirds of a conductivity of copper (when pure copper is a standard for 100% IACS, pure aluminum has approximately 66% IACS), an aluminum conductor wire needs to have a cross sectional area of approximately 1.5 times greater than a cross sectional area of a copper conductor wire to allow the same electric current as the electric current flowing through the copper conductor wire to flow through the aluminum conductor wire. Even when an aluminum conductor wire having an increased cross sectional area as described above is used, using an aluminum conductor wire is advantageous from the viewpoint of lightweighting, since an aluminum conductor wire has a mass of about half the mass of a pure copper conductor wire. Note that "% IACS" represents a conductivity when a resistivity $1.7241\times10^{-8}$ Ωm of International Annealed Copper Standard is taken as 100% IACS.

However, a pure aluminum wire, typically an aluminum alloy wire for transmission lines (Japanese Industrial Standard A1060 and A1070), is known for being poor in its tensile strength, elongation, and resistance to impact or the like as compared with copper. When a pure aluminum wire is used for an extra fine wire having a wire diameter of 0.5 mm or less, the pure aluminum wire cannot withstand plastic deformation caused by a load or the like abruptly applied by an operator or an industrial device or the like while being installed to a car body, and a tension at a crimping portion of a connecting portion between an electric wire and a terminal. When an alloyed wire containing various additive elements added thereto is used, tensile strength can be increased, but a problem is that a conductivity decreases due to a solid solution phenomenon of the additive elements into aluminum, and because of hardening, an ease of routing and handling in attaching a wire harness decreases, which decreases the productivity. Therefore, the additive elements are limited or selected within ranges which would not decrease the conductivity, and it is further necessary to simultaneously provide the tensile strength, the elongation, and the flexibility satisfied at high levels.

For example, 6000 series aluminum alloy wires containing Mg and Si are known as copper alloy wires having a high conductivity and a high strength. Both the high conductivity and the high strength can be achieved by adjusting additive elements, and applying a solution treatment, followed by an aging treatment. Furthermore, the crystal grain size may be refined in order to improve tensile strength and an elongation property which contribute to improvement in resistance to impact. When the 6000 series aluminum alloy wire having a high strength is used, a 0.2% yield strength increases, and thus there is a tendency that a work efficiency of installation to a car body decreases.

Examples of conventional 6000 series aluminum developed as extra fine wires include those described in Japanese Patent Publication No. 5155464. Japanese Patent Publication No. 5155464 discloses an aluminum alloy wire reducing the crystal grain size to realize both a high strength and a high elongation based on the following finding: when coarse grains over 100 μm are present, breakage occurs at the coarse grains, and thereby elongation is decreased.

However, the aluminum alloy wire described in Japanese Patent Publication No. 5155464 refines the crystal grain size to achieve the high strength and the high elongation, but the aluminum alloy wire has a low flexibility as reciprocal properties and an unconsidered 0.2% yield strength, which disadvantageously causes a poor work efficiency of installation to a car body. Furthermore, there is concern that, since a very long electric wire is manufactured in mass-production, a heat treatment condition, a pinning particle distribution, and an element concentration fluctuate, whereby coarse grains are rarely generated, and elongation and strength locally decrease, which result in breaking.

SUMMARY

It is an object of the present disclosure to provide an aluminum alloy wire, an aluminum alloy stranded wire, a covered electric wire, and a wire harness which can realize both a high elongation and a moderate tensile strength without causing a wire break while ensuring a high conductivity, and a moderate low yield strength providing a good work efficiency of installation to a car body even when used as an extra fine wire (for example, the wire diameter is 0.5 mm or less).

The present inventors have conducted research on crystal structure and elongation, and found that an increase in crystal grain size does not necessarily cause a decrease in the elongation, and when coarse grains are suddenly present unevenly, the coarse grains are preferentially plastic-deformed to early cause a necking phenomenon, as a result of which the elongation decreases. That is, it is considered that the conventional finding of refining the crystal grain size to increase the elongation essentially depends on the homogenization of the grain size.

From the above-mentioned research findings, the present inventors found that a uniform coarse structure where coarse grains having a diameter exceeding 100 μm are uniformly present is good, for example, in the case of a wire having a diameter of 100 μm in order to maximally improve an elongation property without having an adverse effect on a flexibility, and a single crystal structure is ideally the best.

It is necessary to anneal the wire at a high temperature for a long time in a solution treatment in order to obtain the uniform coarse structure, but in that case, there is a risk of decrease in the crimping property of a terminal due to the increase in the thickness of a surface oxide film and occurrence of grain boundary cracks due to an increase in the concentration of grain boundaries. Therefore, in this case, a manufacturing method of generating coarse grains in a solution treatment for a short time needs to be examined. Then, as a result of the investigation of influences on the structure after the solution treatment by the conditions of an intermediate heat treatment performed between first wire drawing and second wire drawing and the second wire drawing, the present inventors found that the intermediate heat treatment at a high temperature for a long time and the second wire drawing at a high reduction ratio can facilitate the growth of the coarse grains.

That is, the summary constitution of the present disclosure is as follows.

(1) An aluminum alloy wire having a chemical composition containing 0.10 to 1.00% by mass of Mg, 0.10 to 1.20% by mass of Si, 0.10 to 1.40% by mass of Fe, 0 to 0.10% by mass of Ti, 0 to 0.030% by mass of B, 0 to 1.00% by mass of Cu, 0 to 1.00% by mass of Mn, 0 to 1.00% by mass of Cr, 0 to 0.50% by mass of Zr, and 0 to 0.50% by mass of Ni, the balance being Al and 0.30% by mass or less of impurities, wherein: coarse crystal grains are present in a vertical cross-sectional structure of the wire taken in a lengthwise direction of the wire; the greatest grain size of the coarse crystal grains as measured in the lengthwise direction of the wire is equal to or greater than a diameter of the wire; a proportion of an area of the coarse crystal grains to the total of the areas of all the crystal grains within a range of the vertical cross-sectional structure in which the vertical cross-sectional structure is measured, is 50% or more; and elongation of the wire is 10% or more.

(2) The aluminum alloy wire according to the above (1), wherein a dispersion density of a Mg—Si-based compound having the maximum dimension of 1 μm or less in the vertical cross-sectional structure is 0.1 grain/$\mu m^2$ or more on average.

(3) The aluminum alloy wire according to the above (1) or (2), wherein: a film thickness of an oxide layer formed on a surface of the wire is 500 nm or less; a concentration of each of Mg and Si other than a compound in the vertical cross-sectional structure is 2.0% by mass or less; and the elongation is 15% or more, 0.2% yield strength is 200 MPa or less, and tension strength is 120 MPa or more.

(4) The aluminum alloy wire according to any one of the above (1) to (3), wherein: the proportion of the area of the coarse crystal grains is 70% or more; and the elongation is 20% or more, 0.2% yield strength is 150 MPa or less, and tension strength is 120 MPa or more.

(5) The aluminum alloy wire according to any one of the above (1) to (4), wherein the chemical composition contains one or two selected from the group consisting of 0.001 to 0.100% by mass of Ti and 0.001 to 0.030% by mass of B.

(6) The aluminum alloy wire according to any one of the above (1) to (5), wherein the chemical composition contains one or two selected from the group consisting of 0.01 to 1.00% by mass of Cu, 0.01 to 1.00% by mass of Mn, 0.01 to 1.00% by mass of Cr, 0.01 to 0.50% by mass of Zr, and 0.01 to 0.50% by mass of Ni.

(7) The aluminum alloy wire according to any one of the above (1) to (6), wherein a total of contents of Fe, Ti, B, Cu, Mn, Cr, Zr, and Ni is 0.10 to 2.00% by mass.

(8) The aluminum alloy wire according to any one of the above (1) to (7), wherein a diameter of a strand is 0.1 to 0.5 mm.

(9) An aluminum alloy stranded wire obtained by stranding a plurality of the aluminum alloy wires according to any one of the above (1) to (8).

(10) A covered electric wire containing a covering layer at an outer periphery of the aluminum alloy wire according to any one of the above (1) to (8) or the aluminum alloy stranded wire according to the above (9).

(11) A wire harness containing: the covered electric wire according to the above (10); and a terminal fitted at an end portion of the covered electric wire, the covering layer being removed from the end portion.

Note that, among the elements for which a range of content is specified in the chemical composition, each of those elements for which a lower limit value of the range of content is described as "0% by mass" means a selective additive element that is optionally added as required. That is, when a predetermined additive element is indicated as "0% by mass", it means that such an additive element is not contained.

The aluminum alloy wire of the present disclosure realizes both a high elongation and a moderate tensile strength without causing a wire break while ensuring a high conductivity, and a moderate low yield strength providing a good work efficiency of installation to a car body, whereby the aluminum alloy wire can withstand plastic deformation while a wire harness is attached, and a tensile load, is flexible, and easily handled even when used as a small-diameter wire (for example, the wire diameter is 0.5 mm or less). Accordingly, the aluminum alloy wire makes it unnecessary to prepare a plurality of wires different from each other in properties, allows a single type of wire to have both of the above-described properties. The aluminum alloy stranded wire, the covered electric wire, and the wire harness manufactured by using the aluminum alloy wire are useful as a battery cable, a harness, a conduction wire for a motor, or a wiring structure of an industrial robot or construction or the like.

BRIEF DESCRIPTION OF DRAWINGS

FIG. 1 Cross-sectional images of vertical sections of four aluminum alloy wires captured with an optical microscope, wherein

DETAILED DESCRIPTION

Description of Embodiments

Figure 1A:
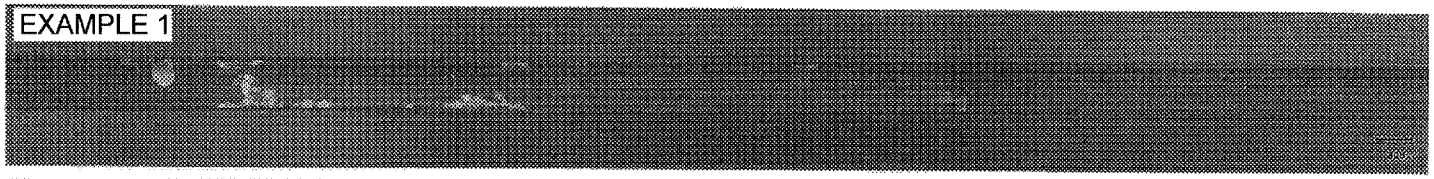
FIG. 1A illustrates a wire of Example 1.
Figure 1B:
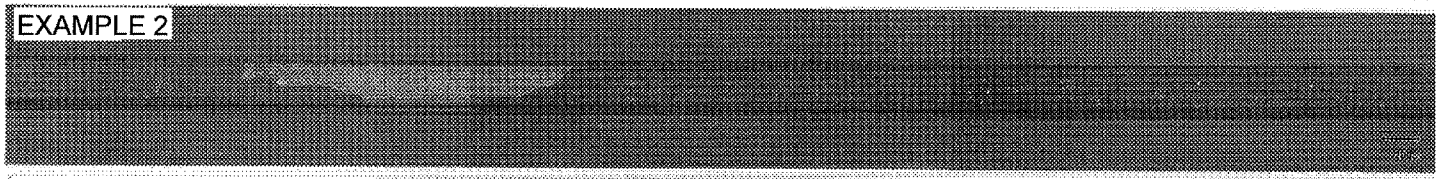
FIG. 1B illustrates a wire of Example 2.
Figure 1C:
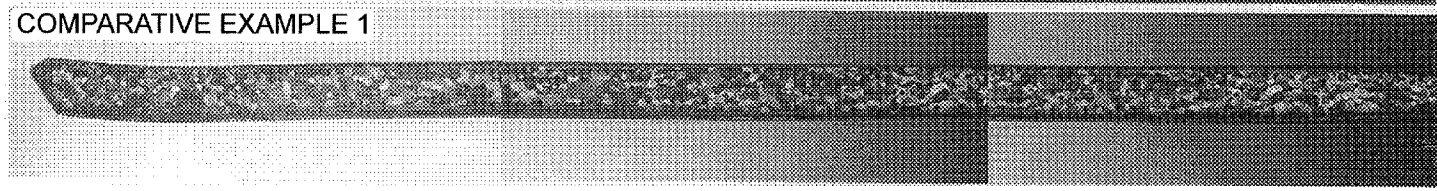
FIG. 1C illustrates a wire of Comparative Example 1.
Figure 1D:
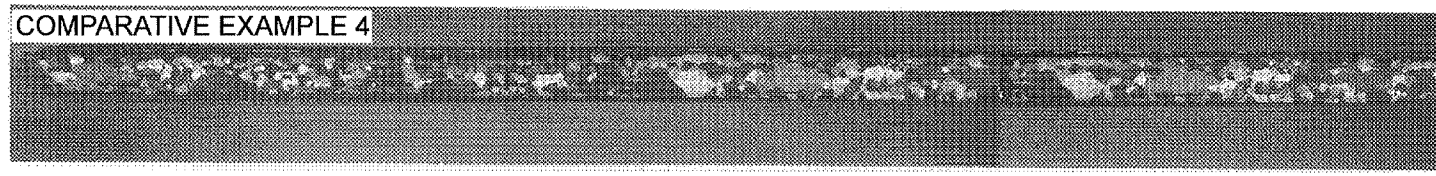
FIG. 1D illustrates a wire of Comparative Example 4.

Hereinafter, reasons for limiting the chemical compositions or the like of the present disclosure will be described.

(1) Chemical Compositions

<Mg: 0.10 to 1.00% by Mass>

Mg (magnesium) has an effect of strengthening by dissolving in an aluminum matrix, and a part of it has an effect of improving tensile strength by being precipitated as a β"-phase (beta double prime phase) or the like together with Si. When it forms a Mg—Si cluster as a solute atom cluster, it is an element having an effect of improving tensile strength and elongation. However, when Mg content is less than 0.10% by mass, the above effects are insufficient. When Mg content exceeds 1.00% by mass, there is an increased possibility of formation of a Mg-concentration part on a grain boundary, which may cause a decrease in tensile strength and elongation. Due to an increased dissolving amount of Mg element, the 0.2% yield strength is increased; the ease of routing and handling of an electric wire is decreased; and the conductivity is also decreased. Accordingly, the Mg content is 0.10 to 1.00% by mass. The Mg content is, when a high strength is of importance, preferably 0.50 to 1.00% by mass, and when a conductivity is of importance, preferably 0.10% by mass or more and less than 0.50% by mass. Based on the points described above, the content of Mg is generally preferably 0.3 to 0.7% by mass.

<Si: 0.10 to 1.20% by Mass>

Si (silicon) has an effect of strengthening by dissolving in an aluminum matrix, and a part of it has an effect of improving tensile strength by being precipitated as a β" phase or the like together with Mg. Also, when it forms a Mg—Si cluster or a Si—Si cluster as a solute atom cluster, it is an element having an effect of improving tensile strength and elongation. However, when Si content is less than 0.10% by mass, the above effects are insufficient. When Si content exceeds 1.20% by mass, there is an increased possibility of formation of a Si-concentration part on a grain boundary, which may cause a decrease in tensile strength and elongation. Also, due to an increased dissolving amount of a Si element, the 0.2% yield strength is increased, the ease of routing and handling of an electric wire is decreased, and the conductivity is also decreased. Accordingly, the Si content is 0.10 to 1.20% by mass. The Si content is, when high strength is of importance, preferably 0.50 to 1.20% by mass, and when conductivity is of importance, preferably 0.10% by mass or more and less than 0.50% by mass. Based on the points described above, the Si content is generally preferably 0.3 to 0.7% by mass.

<Fe: 0.10 to 1.40% by Mass>

Fe (iron) is an element that contributes to refinement of crystal grains mainly by forming an Al—Fe based intermetallic compound and provides an improved tensile strength. Fe dissolves in Al only by 0.05% by mass at 655° C., and even less at room temperature. Accordingly, the remaining Fe that cannot dissolve in Al will be crystallized or precipitated as an intermetallic compound such as Al—Fe, Al—Fe—Si, or Al—Fe—Si—Mg. An intermetallic compound mainly composed of Fe and Al as exemplified by the above-described intermetallic compounds is herein referred to as a Fe-based compound. The generation of the intermetallic compound has an effect of hindering movement of transposition to provide improved tensile strength. Fe has, also by Fe that has dissolved in Al, an effect of providing an improved tensile strength. When Fe content is less than 0.10% by mass, those effects are insufficient. When Fe content exceeds 1.40% by mass, a wire drawing workability decreases due to coarsening of crystallized materials or precipitates, and also the 0.2% yield strength increases, thus the ease of routing and handling of an electric wire decreases and the elongation is decreased. Therefore, the Fe content is 0.10 to 1.40% by mass, preferably 0.15 to 0.70% by mass, and more preferably 0.15 to 0.45% by mass.

The aluminum alloy wire of the present disclosure contains Mg, Si and Fe as essential components as described above, and may further contain one or two selected from the group consisting of Ti and B, and one or two or more selected from the group consisting of Cu, Mn, Cr, Zr, and Ni, as necessary.

<Ti: 0.001 to 0.100% by Mass>

Ti (titanium) is an element having an effect of refining the structure of an ingot during dissolution casting. When an ingot has a coarse structure, the ingot cracks during casting or a wire break occurs during a wire processing step, which is industrially undesirable. When the Ti content is less than 0.001% by mass, the aforementioned effect cannot be achieved sufficiently, and when Ti content exceeds 0.100% by mass, the conductivity tends to decrease. Accordingly, the Ti content is 0.001 to 0.100% by mass, preferably 0.005 to 0.050% by mass, and more preferably 0.005 to 0.030% by mass.

<B: 0.001 to 0.030% by Mass>

Similarly to Ti, B (boron) is an element having an effect of refining the structure of an ingot during dissolution casting. When an ingot has a coarse structure, the ingot is apt to crack during casting or a wire break is apt to occur during a wire processing step, which is industrially undesirable. When the B content is less than 0.001% by mass, the aforementioned effect cannot be achieved sufficiently, and when the B content exceeds 0.030% by mass, the conductivity tends to decrease. Accordingly, the B content is 0.001 to 0.030% by mass, preferably 0.001 to 0.020% by mass, and more preferably 0.001 to 0.010% by mass.

<Cu: 0.01 to 1.00% by Mass>, <Mn: 0.01 to 1.00% by Mass>, <Cr: 0.01 to 1.00% by Mass>, <Zr: 0.01 to 0.50% by Mass>, and <Ni: 0.01 to 0.50% by Mass>

At least one of Cu (copper), Mn (manganese), Cr (chromium), Zr (zirconium), and Ni (nickel) is contained by 0.01% by mass or more, which has an effect of hindering movement of transposition to provide an improved tensile strength. On the other hand, when any one of Cu, Mn, Cr, Zr and Ni has a content exceeding the upper limit thereof mentioned above, a wire break is apt to occur since a compound containing such elements coarsens and deteriorates wire drawing workability, and also a conductivity tends to decrease. Therefore, ranges of contents of Cu, Mn, Cr, Zr, and Ni are the ranges described above, respectively. Among elements in this group of elements, it is particularly preferable to contain Ni. When Ni is contained, stress relaxation properties are also confirmed to be improved after strain is introduced, and electrical connection reliability in a terminal crimping portion is improved. Accordingly, it is more preferable that the Ni content is 0.05 to 0.30% by mass.

As for Fe, Ti, B, Cu, Mn, Cr, Zr, and Ni, the sum of the contents of these elements is preferably 0.10 to 2.00% by mass. When the sum of the contents of these elements is greater than 2.00% by mass, the conductivity and the elongation tend to decrease, the wire drawing workability tends to decrease, and further, the increase of the 0.2% yield strength tends to decrease the ease of routing and handling of an electric wire. Therefore, it is preferable that a sum of the contents of the elements is 2.00% by mass or less. Since in the aluminum alloy wire of the present disclosure, Fe is an essential element, the sum of the contents of Fe, Ti, B, Cu, Mn, Cr, Zr, and Ni is preferably 0.10 to 2.00% by mass. When these elements are added alone, the compound containing the element tends to coarsen more as the content increases. Since this may degrade wire drawing workability and a wire break is apt to occur, the content ranges of the respective elements are as specified above.

In order to moderately decrease the yield strength value, while maintaining a high conductivity, the sum of the contents of Fe, Ti, B, Cu, Mn, Cr, Zr, and Ni is particularly preferably 0.10 to 0.80% by mass, and further preferably 0.15 to 0.60% by mass. On the other hand, although the conductivity is slightly decreased, in order to further increase the tensile strength and the elongation, and at the same time, in order to moderately decrease the yield strength value in relation to the tensile strength, the aforementioned content sum is particularly preferably greater than 0.80% by mass and 2.00% by mass or less, and more preferably 1.00 to 2.00% by mass.

<Balance: Al and 0.3% by Mass or Less of Impurities>

The balance, i.e., components other than those described above, includes Al (aluminum) and impurities. Herein, impurities mean impurities contained at a level which can be contained inevitably during the manufacturing process. Since these impurities may cause a decrease in a conductivity depending on a content thereof, it is preferable to suppress the content of the impurities to some extent considering the decrease in the conductivity. Examples of components that may be impurities include Ga (gallium), Zn (zinc), Bi (bismuth), and Pb (lead).

(2) Configuration, Structure, and Properties of Aluminum Alloy Wire of the Present Disclosure (i) Coarse crystal grains are present in a vertical cross-sectional structure of the wire taken in a lengthwise direction of the wire; the greatest grain size of the coarse crystal grains as measured in the lengthwise direction of the wire is equal to or greater than a diameter of the wire; a proportion of an area of the coarse crystal grains to the crystal grains in a predetermined measured area in the vertical cross-sectional structure, is 50% or more; and elongation of the wire is 10% or more.

The aluminum alloy wire of the present disclosure is characterized in that the coarse crystal grains are present in the vertical cross-sectional structure of the wire taken in the lengthwise direction of the wire; the greatest grain size of the coarse crystal grains as measured in the lengthwise direction of the wire is equal to or greater than the diameter of the wire; the proportion of the area of the coarse crystal grains to the crystal grains present in a predetermined measured area in the vertical cross-sectional structure, is 50% or more; and the elongation of the wire is 10% or more.

The crystal grains equal to or greater than the diameter of the wire are present, which make it possible to provide a high elongation of 10% or more and a small 0.2% yield strength. In the case of a heterogeneous structure in which fine grains are mixed, a decrease in the elongation and an increase in the 0.2% yield strength may occur, whereby the area of the coarse crystal grains must be retained at least 50% or more.

In addition, when it is necessary to further reduce the 0.2% yield strength while further improving the elongation, the proportion of the area of the coarse crystal grains is preferably 70% or more. The proportion of the area can be measured by observing and analyzing the vertical section of the aluminum wire taken in the lengthwise direction of the aluminum wire, for example, using a thermal field emission scanning electron microscope (device name "JSM-7001FA" manufactured by JEOL Co., Ltd.) and an analysis software "OIM Analysis". A scanning step (resolution) is 1 μm, and a crystal grain boundary is defined as a boundary surface between crystal grains in which aluminum atom arrangement is shifted by 15 degrees or more. Since the coarse crystal grains equal to or greater than the diameter are generated in the wire of the present disclosure, the area of at least 10 $mm^2$ of the vertical section of the aluminum wire taken in the lengthwise direction of the aluminum wire needs to be observed and measured.

(ii) A dispersion density of a Mg—Si-based compound having the maximum dimension of 1 μm or less in the vertical cross-sectional structure of the wire is 0.1 grain/μm' or more on average.

In the aluminum alloy wire of the present disclosure, the dispersion density (precipitation density) of the Mg—Si-based compound having the maximum dimension of 1 μm or less in the vertical cross-sectional structure of the wire is preferably 0.1 grain/$\mu m^2$ or more on average.

The dispersion density of the Mg—Si-based compound having the maximum dimension of 1 μm or less is 0.1 grain/μm' or more on average, whereby the tensile strength can be set to 120 MPa or more. This is because precipitates unmatched with the matrix are formed, to cause less contribution to an increase in strength when the maximum dimension exceeds 1 μm even if the dispersion density of the Mg—Si-based compound is 0.1 grain/$\mu m^2$ or more on average, whereby no desired strength tends to be obtained. The dispersion density is measured by forming a thin film by a focused ion beam (FIB) method from an aluminum alloy wire, subjecting the thin film to composition analysis according to energy dispersive X-ray spectroscopy (EDX) based on an image captured by using a transmission electron microscope (TEM) to identify a constituent element, and counting compounds in which the detection intensities of Mg and Si is 10% or more of the intensities of Mg and Si dissolving in a matrix and the maximum dimension is 1 μm or less. The average value of three measurement data is used for the dispersion density of the Mg—Si-based compound. In each of points of measurement, a continuous area of at least 100 $\mu m^2$ or more is measured, and the dispersion density (grain/$\mu m^2$) of the compound is calculated. The sample thickness of the thin film is calculated with 0.15 μm being taken as a reference thickness. When the sample thickness is different from the reference thickness, the dispersion density of the Mg—Si-based compound (of a reference thickness) can be calculated by converting the sample thickness with the reference thickness, that is, multiplying (reference thickness/sample thickness) by a dispersion density of the sample thickness calculated based on the captured image.

(iii) A film thickness of an oxide layer formed on a surface of the wire is 500 nm or less; and a concentration of each of Mg and Si other than a compound in the vertical cross-sectional structure is 2.0% by mass or less.

Furthermore, in the aluminum alloy wire of the present disclosure, it is preferable that the film thickness of the oxide layer formed on the surface of the wire is 500 nm or less, and the concentration of each of Mg and Si other than the compound in the vertical cross-sectional structure is 2.0% by mass or less. When the film thickness of the oxide layer exceeds 500 nm, contact resistance in a terminal crimping portion increases, which risks causing deterioration in a terminal crimping property. This is because grain boundary cracks (grain boundary fracture) are apt to be generated by the increase in the concentration of grain boundaries when the concentration of at least one of Mg and Si other than the compound in the vertical cross-sectional structure is higher than 2.0% by mass. The film thickness of the oxide layer formed on the surface of the wire is measured by using an Auger electron spectrometer. An average value calculated from the measurement values at three spots in total is taken as the film thickness of the oxide layer formed on the surface of the wire. In consideration of the variation in the lengthwise direction, the measurements are performed by spacing apart the first spot and the second spot by 1000 mm or more in the lengthwise direction of the wire, spacing apart the first spot and the third spot by 2000 mm or more in the lengthwise direction of the wire, and spacing apart the second spot and the third spot by 1000 mm or more in the lengthwise direction of the wire. The concentrations of Mg and Si other than the compound in the vertical cross-sectional structure are measured by using TEM and EDX in the same manner as in the method of measuring the dispersion densities of the Mg and Si compounds. A sample is produced by a FIB method such that an area of 300 μm' or more in total is obtained, and subjected to area analysis in order to investigate Mg and Si concentrations. In the above-mentioned vertical cross-sectional structure, portions in which the concentrations of Mg and Si are high are subjected to quantitative analysis. When a high-concentration portion in which the concentration of at least one of Mg and Si is more than 2.0% by mass is found, a diffraction pattern is observed, and when a different diffraction pattern from an aluminum matrix is obtained, the diffraction pattern is determined as the compound, and excluded from the count.

(3) Properties of Aluminum Alloy Wire of the Present Disclosure

The aluminum alloy wire of the present disclosure preferably has elongation of 15% or more and tensile strength of 120 MPa or more from the viewpoint of being less likely to cause a wire break, and a 0.2% yield strength of 200 MPa or less from the viewpoint of improving the ease of routing and handling of the wire such as installation to a car body, for example, even when used as an extra fine wire (for example, the wire diameter is 0.5 mm or less). Furthermore, when the ease of routing and handling of the wire is considered to be important, the aluminum alloy wire more preferably has elongation 20% or more and a 0.2% yield strength of 150 MPa or less while having tensile strength maintained at 120 MPa or more.

In order to prevent heat generation due to joule heat, the conductivity is preferably equal to or greater than 40% IACS, and more preferably equal to or greater than 45% IACS. The conductivity is still more preferably equal to or greater than 50% IACS, and in this case, a further reduction of the diameter can be achieved.

(4) Method of Manufacturing Aluminum Alloy Wire According to an Example of the Present Disclosure Such an aluminum alloy wire can be realized by combining and controlling alloy compositions and manufacturing processes. Hereinafter, a preferred method of manufacturing an aluminum alloy wire of the present disclosure will be described.

The aluminum alloy wire according to one Example of the present disclosure can be manufactured through a manufacturing method including sequentially performing each process of [1] melting, [2] casting, [3] hot working (grooved roll working or the like), [4] first wire drawing, [5] intermediate heat treatment (intermediate annealing), [6] second wire drawing, [7] first heat treatment (solution heat treatment), and [8] second heat treatment (aging heat treatment). A stranding step or a wire resin-covering step may be provided before or after the solution heat treatment or after the aging heat treatment. Hereinafter, steps of [1] to [8] will be described.

[1] Melting

In the melting step, a material is prepared by adjusting quantities of each component such that the aforementioned aluminum alloy composition is obtained, and the material is melted.

[2] Casting and [3] Hot Working (Grooved Roll Working or the Like)

Subsequently, in the casting step, the cooling rate is increased, and the crystallization of the Fe-based compound is moderately reduced and subjected to refinement. For example, a bar having a diameter of 5 to 15 mm can be obtained by setting the average cooling rate, during casting, from the molten metal temperature to 400° C., preferably at 20 to 50° C./s, and by using a Properzi-type continuous casting rolling mill which is an assembly of a casting wheel and a belt. When an in-water spinning method is used, a bar having a diameter of 1 to 13 mm can be obtained at an average cooling rate of 30° C./s or more. Casting and hot working (rolling) may be performed by billet casting and an extrusion technique or the like. After the casting or the hot working, a re-heat treatment may also be applied, and when the re-heat treatment is applied, the time in which the temperature is retained at 400° C. or higher is preferably 30 minutes or less.

[4] First Wire Drawing

Subsequently, the roughly-drawn wire obtained by hot working is subjected to cold wire drawing so as to have an intended intermediate annealing wire diameter. The intended intermediate annealing wire diameter is determined by an intended reduction ratio in second wire drawing. For example, when a wire having a wire diameter ϕ of 0.3 mm is produced at the reduction ratio of 99.5% in the second wire drawing, the intended intermediate annealing wire diameter ϕ is 4.3 mm. Herein, the "reduction ratio" is calculated from a value obtained by multiplying a value obtained by dividing the difference between the cross-sectional areas of the wire before and after wire drawing by the cross-sectional area of the wire before wire drawing by 100. When the surface of the wire needs to be cleaned, the surface of the wire is suitably peeled off.

[5] Intermediate Heat Treatment (Intermediate Annealing)

Thereafter, an intermediate heat treatment is performed in order to form a structure where crystal grains are likely to grow in the second heat treatment. The intermediate heat treatment also serves as a softening treatment, and is usually performed for the purpose of softening when the accumulation of processing strain causes a wire break during wire drawing. In the present disclosure, the intermediate heat treatment is performed in order to realize a structure where the crystal grains are likely to grow during recrystallization. Specifically, the second heat treatment is preferably performed at 250 to 600° C., and more preferably at 250° C. or higher and lower than 350° C. for 5 hours or more, at 350° C. or higher and lower than 500° C. for 3 hours or more, or at 500° C. or higher and 600° C. or lower for 1 hour or more. A cooling rate in the second heat treatment is preferably 5° C./min or less. When the surface oxide film grows, annealing is performed in an inactive gas atmosphere such as Ar gas.

[6] Second Wire Drawing

Thereafter, cold wire drawing (second wire drawing) is performed at a high reduction ratio in order to form a structure where crystal grains are likely to grow in the second heat treatment as a post-process. Specifically, the reduction ratio is preferably 95.0% or more, and more preferably 99.0% or more. Furthermore, the reduction ratio is suitably 99.9% or more in that the growth of the crystal grains in the second heat treatment is further promoted. This is because, when the reduction ratio is less than 95.0%, the coarse crystal grains are less likely to be generated in the second heat treatment, which tends to cause reductions in tensile strength and elongation caused by a heterogeneous structure, and the first heat treatment is required to be performed at a high temperature for a long time, which may cause an increase in contact resistance in a terminal crimping portion caused by the growth of the surface oxide film, and decreases in tensile strength and elongation caused by increases in the concentrations of Mg and Si in the grain boundary.

[7] First Heat Treatment (Solution Heat Treatment)

The work piece subjected to wire drawing is subjected to a first heat treatment. The first heat treatment of the present embodiment is a solution heat treatment for causing Mg and Si compounds dispersed to dissolve in an aluminum matrix. The solution treatment provides an uniform Mg—Si solid solution structure, which makes it possible to obtain a uniform aging precipitation structure in an aging heat treatment as the subsequent heat treatment process. The first heat treatment is preferably performed at 500 to 600° C., and more preferably at 500° C. or higher and lower than 550° C. for 5 hours or more or at 550° C. or higher and 600° C. or lower for 30 minutes or more. Cooling in the first heat treatment is preferably performed at an average cooling rate of 10° C./s or more at least a temperature of 150° C. or lower. When the retention temperature of the first heat treatment is higher than 600° C., the growth of the surface oxide film, and the increases in the concentrations of Mg and Si in the grain boundary occur. When the retention temperature is lower than 500° C., $Mg_2Si$ cannot sufficiently dissolve. The retention temperature of lower than 500° C. is unsuitable for mass-production since the growth of the crystal grains requires time.

A method of performing the first heat treatment may be, for example, batch annealing or salt bath, or may be a continuous heat treatment such as high-frequency heating, conduction heating, or running heating.

The continuous heat treatment by high-frequency heating is a heat treatment by joule heat generated from the wire itself by an induced current by the wire continuously passing through a magnetic field caused by a high frequency. When prolonged annealing is difficult, a plurality of annealing times may be totaled to provide a suitable heat treatment time. The cooling is performed by continuously allowing the wire to pass through water or a nitrogen gas atmosphere.

The continuous conducting heat treatment is a heat treatment by joule heat generated from the wire itself by allowing an electric current to flow in the wire that continuously passes two electrode wheels. When prolonged annealing is difficult, a plurality of annealing times may be totaled to provide a suitable heat treatment time. The cooling is performed by continuously allowing the wire to pass through water or a nitrogen gas atmosphere.

A continuous running heat treatment is a heat treatment in which the wire continuously passes through a heat treatment furnace retained at a high temperature. When prolonged annealing is difficult, a plurality of annealing times may be totaled to provide a suitable heat treatment time. The cooling is performed by continuously allowing the wire to pass through water, atmosphere or a nitrogen gas atmosphere.

[8] Second Heat Treatment (Aging Heat Treatment)

Subsequently, a second heat treatment is applied. The second heat treatment is an aging heat treatment performed for producing Mg and Si compounds or solute atom clusters. In the aging heat treatment, heating is performed at a predetermined temperature within a range from 20° C. to 250° C. When the predetermined temperature in the aging heating treatment is lower than 20° C., the production of the solute atom cluster is slow and requires time to obtain a necessary tensile strength and elongation, and thus it is disadvantageous for mass-production. When the predetermined temperature is higher than 250° C., in addition to the $Mg_2Si$ needle-like precipitate (β" phase) most contributing to the strength, coarse $Mg_2Si$ precipitates are produced to decrease the strength. Accordingly, the predetermined temperature is preferably 20° C. to 70° C. when the solute atom cluster being more effective in improving elongation is produced, and is preferably 100° C. to 150° C. when the β" phase is simultaneously precipitated, and the balance between the tensile strength and the elongation is required to be achieved. It is necessary to adjust the retention time according to a retention temperature and properties to be required. For example, when a high elongation material is required, heating is preferably performed at a low temperature for a long time or a high temperature for a short time. Herein, the "long time" means, for example, more than 15 hours and 10 days or less, and the "short time" means, for example, 15 hours or less. In the cooling in the aging heat treatment, in order to prevent dispersion of the properties, it is preferable to increase the cooling rate as much as possible. Of course, even when cooling cannot be quickly performed due to the manufacturing process, the cooling rate can be appropriately set in an aging condition in which solute atom clusters are sufficiently produced.

A strand diameter of the aluminum alloy wire of the present embodiment is not particularly limited, and can be determined appropriately according to the purpose of use, and is preferably ϕ 0.1 mm to 0.5 mm for a fine wire, and ϕ 0.8 mm to 1.5 mm for a middle sized wire. The aluminum alloy wire of the present embodiment is advantageous in that the aluminum alloy wire can be used as a thin single wire as an aluminum alloy wire. However, the aluminum alloy wire may also be used as an aluminum alloy stranded wire obtained by stranding a plurality of them together, and among the steps [1] to [8] of the manufacturing method of the present disclosure, after bundling and stranding a plurality of aluminum alloy wires obtained by sequentially performing the respective steps [1] to [6], the steps of [7] the solution heat treatment and [8] the aging heat treatment may also be performed.

In the present embodiment, such a homogenizing heat treatment as performed in the prior art may be further performed as an additional step after the casting step or the hot working. Since the homogenizing heat treatment can uniformly disperse the added elements, a solute atom cluster and the β" precipitation phase are likely to be uniformly produced in the subsequent second heat treatment, which provides a stable tensile strength and elongation independent of points of measurement. The homogenizing heat treatment is performed at a heating temperature of preferably 450° C. to 600° C. and more preferably 500° C. to 600° C. The cooling in the homogenizing heat treatment is preferably slow cooling at an average cooling rate of 0.1° C./min to 10° C./min because of the easiness in obtaining a uniform compound.

The aluminum alloy wire of the present disclosure can be used as an aluminum alloy wire, or as an aluminum alloy stranded wire obtained by stranding a plurality of aluminum alloy wires, and may also be used as a covered electric wire having a covering layer at an outer periphery of the aluminum alloy wire or the aluminum alloy stranded wire. In addition, the aluminum alloy wire can also be used as a wire harness (assembly electric wire) having a covered electric wire and a terminal fitted at an end portion of the covered electric wire, the covering layer being removed from the end portion.

EXAMPLES

Examples and Comparative Examples

Alloy materials containing Mg, Si, Fe and Al, as essential components and at least one of Ti, B, Cu, Mn, Cr, Zr, and Ni as an selectively added component with chemical compositions (% by mass) shown in Table 1 were prepared, and the alloy materials were continuously rolled while being cast by using a Properzi-type continuous casting rolling mill with a mold obtained by cooling the molten metals with water, to obtain bars having a diameter ϕ of 9 mm. Subsequently, this was subjected to first wire drawing to obtain a predetermined reduction ratio. Then, the work pieces subjected to the first wire drawing were subjected to intermediate annealing (intermediate heat treatment) under the conditions shown in Table 2, and further subjected to second wire drawing to obtain a predetermined reduction ratio until a wire size having a wire diameter ϕ of 0.3 mm was obtained. Then, the work pieces were subjected to a first heat treatment (solution heat treatment) under the conditions shown in Table 2. Both in the intermediate annealing and in the first heat treatment, in a case of a batch heat treatment, the wire temperature was measured with a thermocouple wound around the wire. In the continuous conducting heat treatment, since measurement at a portion where the temperature of the wire was the highest was difficult due to equipment, the temperature was measured with a fiber optic radiation thermometer (manufactured by Japan Sensor Corporation) at a position upstream of a portion where the temperature of the wire was highest, and the maximum temperature was calculated in consideration of joule heat and heat dissipation. In each of the high-frequency heating and the consecutive running heat treatment, the wire temperature in the vicinity of the heat treatment section outlet was measured. The second heat treatment (aging heat treatment) was applied under the conditions shown in Table 2, to manufacture aluminum alloy wires.

For each of the produced aluminum alloy wires of Examples and Comparative Examples, the respective properties were measured by the methods shown below.

(A) Method of Measuring Conductivity (EC)

In a constant temperature bath in which a test piece having a length of 300 mm was held at 20° C. (±0.5° C.), a resistivity was measured for three materials under test (aluminum alloy wires) each time using a four terminal method, and an average conductivity was calculated. The distance between the terminals was 200 mm. In the present Examples, the conductivity of equal to or greater than 40% IACS was regarded as an acceptable level.

(B) Methods of Measuring Tensile Strength, 0.2% Yield Strength, and Elongation after Fracture In conformity with JIS Z 2241: 2011, each of three materials under test (aluminum alloy wires having a diameter ϕ of 0.3 mm) was subjected to a tensile test. The greatest stress in the obtained stress-strain curve (S—S curve) was taken as tensile strength; stress when 0.2% permanent strain occurs was taken as a 0.2% yield strength; an elongation rate after fracture to an initial length was taken as elongation after fracture; and the average values thereof were taken as the physical property values. Since a high elongation which was less likely to cause fracture from deformation was required for a small-diameter wire, the elongation of 15% or more was regarded as acceptance. Since a reduction in an attachment load to a car body was required, the 0.2% yield strength of 200 MPa or less which was likely to be plastic-deformed was regarded as acceptance. Since a strength which can withstand impact shock when attached to a car body was required, the tensile strength of 120 MPa or more was regarded as acceptance.

(C) Method of Measuring Proportion of Area of Coarse Crystal Grains

The proportion of an area of coarse crystal grains in the present Examples can be measured by cutting about 10 mm of an aluminum wire having a diameter ϕ of 0.3 mm, embedding the aluminum wire in a resin, performing polishing until about half of the wire was scraped such that the wire and the polished surface were parallel to each other, subjecting the surface to chemical etching, and observing and analyzing the surface using a thermal field emission scanning electron microscope (device name "JSM-7001FA" manufactured by JEOL Co., Ltd.) and an analysis software "OIM Analysis" after carbon deposition. A scanning step (resolution) was 1 μm, and a crystal grain boundary was defined as a boundary surface between crystal grains in which aluminum atom arrangement was shifted by 15 degrees or more. Furthermore, 30 samples were produced per one kind of material, and the area of 100 $mm^2$ or more in total was measured. When the grain boundary can be clearly determined, or the proportion of the area of the material is likely obtained, microscope observation as a simple technique may be performed. In that case, the sample polished after embedding the wire in the resin is subjected to electric-field polishing and an anodizing treatment, and microscope observation through a polarizing plate.

(D) Method of Measuring Dispersion Densities (Precipitation Densities) of Mg and Si Compounds The dispersion densities (precipitation densities) of Mg and Si compounds were measured by forming a thin film from each of the aluminum alloy wires of Examples and Comparative Examples by a FIB method, subjecting the thin film to composition analysis according to EDX based on an image captured by using a transmission electron microscope (TEM) to identify a constituent element, and counting compounds in which the detection intensities of Mg and Si was 10% or more of the intensities of Mg and Mg dissolving in a matrix and the maximum dimension was 1 μm or less. The average value of three measurement data is used for the dispersion density of the Mg—Si-based compound. In each of points of measurement, a continuous area of at least 100 $\mu m^2$ or more was measured, and the dispersion density (grain/$\mu m^2$) of the compound was calculated. The sample thickness of the thin film was calculated with 0.15 μm being taken as a reference thickness. When the sample thickness is different from the reference thickness, the dispersion density of the Mg—Si-based compound (of a reference thickness) can be calculated by converting the sample thickness with the reference thickness, that is, multiplying (reference thickness/sample thickness) by a dispersion density of the sample thickness calculated based on the captured image.

(E) Method of Measuring Concentrations of Mg and Si in Vertical Cross-Sectional Structure of Wire The concentrations of Mg and Si other than a compound in the vertical cross-sectional structure of a wire were measured by using TEM and EDX in the same manner as in the method of measuring the dispersion densities of Mg and Si compounds. A sample was produced by a FIB method such that the area of 300 $\mu m^2$ or more in total was obtained, and subjected to area analysis in order to investigate Mg and Si concentrations. In the above-mentioned vertical cross-sectional structure, portions in which the concentrations of Mg and Si were high were subjected to quantitative analysis. When a high-concentration portion in which the concentration of at least one of Mg and Si was more than 2.0% by mass was found, a diffraction pattern was observed. When a diffraction pattern different from an aluminum matrix was obtained, the diffraction pattern was determined as the compound, and excluded from the count.

(F) Method of Measuring Film Thickness of Oxide Layer Formed on Surface of Wire

A film thickness of an oxide layer formed on the surface of a wire was measured by using an Auger electron spectrometer. An average value calculated from the measurement values at three spots in total was taken as a thickness of the surface oxide layer of the wire. In consideration of the variation in a lengthwise direction, the measurements were performed by spacing apart the first spot and the second spot by 1000 mm or more in the lengthwise direction of the wire, spacing apart the first spot and the third spot by 2000 mm or more in the lengthwise direction of the wire, and spacing apart the second spot and the third spot by 1000 mm or more in the lengthwise direction of the wire.

Table 2 shows the results obtained by comprehensively evaluating the properties of the wires by the above-described methods. In the column indicating evaluation in Table 2, "A" indicates a case where elongation is 20% or more; a 0.2% yield strength is 150 MPa or less; and tensile strength is 120 MPa or more. "B" indicates a case where elongation is 15% or more; a 0.2% yield strength is 200 MPa or less; and tensile strength is 120 MPa or more. "C" indicates a case corresponding to at least one of the following conditions: elongation is less than 15%; a 0.2% yield strength is more than 200 MPa; and tensile strength is less than 120 MPa.

TABLE 1

| | Chemical composition (% by mass) | | | | | | | | | | | |
|---|---|---|---|---|---|---|---|---|---|---|---|---|
| | Mg | Si | Fe | Ti | B | Cu | Mn | Cr | Zr | Ni | Total content of Fe, Ti, B, Cu, Mn, Cr, Zr, and Ni | Balance |
| Example 1 | 0.57 | 0.59 | 0.32 | 0.01 | 0.005 | 0.04 | — | — | — | — | 0.375 | Al and 0.3% by mass or less of impurities |
| Example 2 | 0.57 | 0.59 | 0.32 | 0.01 | 0.005 | — | 0.09 | — | — | 0.09 | 0.515 | |
| Example 3 | 0.49 | 0.60 | 0.19 | 0.01 | 0.01 | — | 0.05 | 0.05 | — | — | 0.350 | |
| Example 4 | 0.50 | 0.61 | 0.15 | 0.02 | 0.01 | — | — | — | 0.05 | — | 0.270 | |
| Example 5 | 0.39 | 0.91 | 0.25 | 0.02 | 0.005 | — | — | — | — | — | 0.275 | |
| Comparative Example 1 | 0.88 | 0.64 | 0.30 | 0.06 | 0.012 | 0.18 | — | 0.14 | — | — | 0.692 | |
| Comparative Example 2 | — | — | 0.20 | 0.01 | 0.005 | — | — | — | — | — | 0.215 | |
| Comparative Example 3 | 0.49 | 0.60 | 2.04 | 0.01 | 0.05 | — | — | — | 0.50 | 0.30 | 2.900 | |
| Comparative Example 4 | 1.20 | 1.50 | 0.20 | 0.01 | 0.05 | 0.09 | 0.05 | 0.06 | — | — | 0.460 | |
| Comparative Example 5 | 0.88 | 0.64 | — | 0.02 | 0.004 | — | — | — | — | — | 0.024 | |

(Note)
Numerical values of underlined portions in Table are outside appropriate range of the present invention.

TABLE 2

| | Manufacturing conditions | | | | | | | Structure of wire | | | |
|---|---|---|---|---|---|---|---|---|---|---|---|
| | Intermediate annealing | | Second wire | First heat treatment | | Second heat treatment | | Proportion of area of coarse grains (%) | Precipitation density of Mg, Si (grain/μm²) | Thickness of surface oxide film, (nm) | Presence or absence of portion in which Mg and Si concentrations are more than 2% |
| | Heating temperature (° C.) | Retention time (h) | drawing Reduction ratio (%) | Temperature (° C.) | Retention time (h) | Temperature (° C.) | Retention time (h) | | | | |
| Example 1 | 300 | 8 | 99.0 | 580 | 1 | 150 | 45 | 88 | 6.2 | 311 | Absence |
| Example 2 | 350 | 4 | 99.0 | 580 | 15 | 100 | 5 | 99 | 1.8 | 470 | Absence |
| Example 3 | 350 | 8 | 99.5 | 550 | 3 | 150 | 8 | 73 | 2.5 | 48 | Absence |
| Example 4 | 250 | 12 | 99.5 | 600 | 0.5 | 180 | 5 | 82 | 5.1 | 220 | Absence |
| Example 5 | 520 | 1 | 99.9 | 530 | 5 | 150 | 3 | 96 | 2.8 | 52 | Absence |
| Comparative Example 1 | 300 | 3 | 99.0 | 530 | 3 | 140 | 8 | 0 | 4.4 | 70 | |
| Comparative Example 2 | 300 | 2 | 99.0 | 550 | 2 | — | — | 72 | 0 | 66 | Absence |
| Comparative Example 3 | 300 | 2 | 99.0 | 620 | 3 | 150 | 8 | 84 | 2.5 | 600 | Presence |
| Comparative Example 4 | 300 | 2 | 60.0 | 580 | 5 | 150 | 8 | 5 | 7.6 | 250 | Absence |

TABLE 2-continued

| | | | | | | | | | | | |
|---|---|---|---|---|---|---|---|---|---|---|---|
| Comparative Example 5 | 300 | 3 | 99.0 | 530 | 3 | 180 | 8 | 14 | 5.5 | 75 | Absence |

| | Properties | | | | |
|---|---|---|---|---|---|
| | Elongation (%) | 0.2% Yield strength (MPa) | Tensile strength (MPa) | Conducivity (% IACS) | Comprehensive evaluation |
| Example 1 | 16 | 173 | 185 | 52 | B |
| Example 2 | 26 | 51 | 122 | 45 | A |
| Example 3 | 16 | 130 | 159 | 48 | B |
| Example 4 | 19 | 184 | 212 | 50 | B |
| Example 5 | 25 | 61 | 132 | 51 | A |
| Comparative Example 1 | 16 | 240 | 302 | 44 | C |
| Comparative Example 2 | 25 | 45 | 96 | 65 | C |
| Comparative Example 3 | 4 | 51 | 80 | 52 | C |
| Comparative Example 4 | 7 | 297 | 360 | 36 | C |
| Comparative Example 5 | 2 | 161 | 201 | 49 | C |

(Note)
Numerical values of underlined portions in Table are outside appropriate range of the present invention.

From the results shown in Table 2, it is found that each of the aluminum alloy wires of Examples 1 to 5 has a high elongation of 16% or more, a moderately low 0.2% yield strength of 184 MPa or less, tensile strength of 122 MPa or more, and a high conductivity of 45% IACS or more, and exhibits comprehensive evaluation of "B" or more. In particular, each of Examples 2 and 5 had tensile strength maintained at 122 MPa or more, a high elongation of 25% or more, and a dominantly low 0.2% yield strength of 61 MPa or less, and exhibited comprehensive evaluation of "A".

On the other hand, in the aluminum alloy wire of Comparative Example 1, the coarse crystal grains in the vertical section of the wire were not present, that is, the proportion of the area of the coarse crystal grains was 0%, whereby the aluminum alloy wire had a 0.2% yield strength of 240 MPa which was higher than 200 MPa and a poor ease of routing and handling of an electric wire, and exhibited comprehensive evaluation of "C". The aluminum alloy wire of Comparative Example 2 did not contain Mg and Si, whereby the aluminum alloy wire had an insufficient tensile strength of 96 MPa, and exhibited comprehensive evaluation of "C". In Comparative Example 3, the contents of Fe and B were higher than the appropriate range, and the additive elements were concentrated in the grain boundary by the first heat treatment (solution heat treatment) exceeding 600° C. to cause a brittle structure, whereby Comparative Example 3 had a low elongation of 4%, and an insufficient tensile strength of 80 MPa, and exhibited comprehensive evaluation of "C". In Comparative Example 4, the contents of Mg, Si, and B were higher than the appropriate range, and the proportion of the area of the coarse crystal grains was as small as 5%, whereby Comparative Example 4 had an insufficient elongation of 7%, a high 0.2% yield strength of 297 MPa, and a low conductivity of 36% IACS, and exhibited comprehensive evaluation of "C". Comparative Example 5 did not contain Fe, and the proportion of the area of the coarse crystal grains was as small as 14%, whereby Comparative Example 5 had an insufficient elongation of 2%, and exhibited comprehensive evaluation of "C".

The aluminum alloy wire of the present disclosure realizes both a high elongation and a moderate tensile strength without causing a wire break while ensuring a high conductivity, and a moderate low yield strength providing a good work efficiency of installation to a car body, whereby the aluminum alloy wire can withstand plastic deformation while a wire harness is attached, and a tensile load, is flexible, and easily handled even when used as a small-diameter wire (for example, the wire diameter is 0.5 mm or less). Accordingly, the aluminum alloy wire makes it unnecessary to prepare a plurality of wires different from each other in properties, allows a single type of wire to have both of the above-described properties. The aluminum alloy stranded wire, the covered electric wire, and the wire harness manufactured by using the aluminum alloy wire are useful as a battery cable, a harness, a conduction wire for a motor, or a wiring structure of an industrial robot or construction or the like.

The invention claimed is:

1. An aluminum alloy wire having a chemical composition comprising 0.10 to 1.00% by mass of Mg, 0.10 to 1.20% by mass of Si, 0.10 to 1.40% by mass of Fe, 0 to 0.10% by mass of Ti, 0 to 0.030% by mass of B, 0 to 1.00% by mass of Cu, 0 to 1.00% by mass of Mn, 0 to 1.00% by mass of Cr, 0 to 0.50% by mass of Zr, and 0 to 0.50% by mass of Ni, the balance being Al and 0.30% by mass or less of impurities, wherein:

coarse crystal grains are present in a vertical cross-sectional structure of the wire taken in a lengthwise direction of the wire;

the greatest grain size of the coarse crystal grains as measured in the lengthwise direction of the wire is equal to or greater than a diameter of the wire;

a proportion of an area of the coarse crystal grains to the total of the areas of all the crystal grains within a range of the vertical cross-sectional structure in which the vertical cross-sectional structure is measured, is 50% or more; and elongation of the wire is 10% or more.

2. The aluminum alloy wire according to claim 1, wherein a dispersion density of a Mg—Si-based compound having the maximum dimension of 1 μm or less in the vertical cross-sectional structure is 0.1 grain/$\mu m^2$ or more on average.

3. The aluminum alloy wire according to claim 2, wherein:

a film thickness of an oxide layer formed on a surface of the wire is 500 nm or less;

a concentration of each of Mg and Si other than a compound in the vertical cross-sectional structure is 2.0% by mass or less; and the elongation is 15% or more, 0.2% yield strength is 200 MPa or less, and tension strength is 120 MPa or more.

4. The aluminum alloy wire according to claim 2, wherein:

the proportion of the area of the coarse crystal grains is 70% or more; and the elongation is 20% or more, 0.2% yield strength is 150 MPa or less, and tension strength is 120 MPa or more.

5. The aluminum alloy wire according to claim 2, wherein the chemical composition contains one or two selected from the group consisting of 0.001 to 0.100% by mass of Ti and 0.001 to 0.030% by mass of B.

6. The aluminum alloy wire according to claim 2, wherein the chemical composition contains one or two selected from the group consisting of 0.01 to 1.00% by mass of Cu, 0.01 to 1.00% by mass of Mn, 0.01 to 1.00% by mass of Cr, 0.01 to 0.50% by mass of Zr, and 0.01 to 0.50% by mass of Ni.

7. The aluminum alloy wire according to claim 1, wherein:

a film thickness of an oxide layer formed on a surface of the wire is 500 nm or less;

a concentration of each of Mg and Si other than a compound in the vertical cross-sectional structure is 2.0% by mass or less; and the elongation is 15% or more, 0.2% yield strength is 200 MPa or less, and tension strength is 120 MPa or more.

8. The aluminum alloy wire according to claim 7, wherein:

the proportion of the area of the coarse crystal grains is 70% or more; and the elongation is 20% or more, 0.2% yield strength is 150 MPa or less, and tension strength is 120 MPa or more.

9. The aluminum alloy wire according to claim 7, wherein the chemical composition contains one or two selected from the group consisting of 0.001 to 0.100% by mass of Ti and 0.001 to 0.030% by mass of B.

10. The aluminum alloy wire according to claim 7, wherein the chemical composition contains one or two selected from the group consisting of 0.01 to 1.00% by mass of Cu, 0.01 to 1.00% by mass of Mn, 0.01 to 1.00% by mass of Cr, 0.01 to 0.50% by mass of Zr, and 0.01 to 0.50% by mass of Ni.

11. The aluminum alloy wire according to claim 1, wherein:

the proportion of the area of the coarse crystal grains is 70% or more; and the elongation is 20% or more, 0.2% yield strength is 150 MPa or less, and tension strength is 120 MPa or more.

12. The aluminum alloy wire according to claim 11, wherein the chemical composition contains one or two selected from the group consisting of 0.001 to 0.100% by mass of Ti and 0.001 to 0.030% by mass of B.

13. The aluminum alloy wire according to claim 11, wherein the chemical composition contains one or two selected from the group consisting of 0.01 to 1.00% by mass of Cu, 0.01 to 1.00% by mass of Mn, 0.01 to 1.00% by mass of Cr, 0.01 to 0.50% by mass of Zr, and 0.01 to 0.50% by mass of Ni.

14. The aluminum alloy wire according to claim 1, wherein the chemical composition contains one or two selected from the group consisting of 0.001 to 0.100% by mass of Ti and 0.001 to 0.030% by mass of B.

15. The aluminum alloy wire according to claim 1, wherein the chemical composition contains one or two selected from the group consisting of 0.01 to 1.00% by mass of Cu, 0.01 to 1.00% by mass of Mn, 0.01 to 1.00% by mass of Cr, 0.01 to 0.50% by mass of Zr, and 0.01 to 0.50% by mass of Ni.

16. The aluminum alloy wire according to claim 1, wherein a total of contents of Fe, Ti, B, Cu, Mn, Cr, Zr, and Ni is 0.10 to 2.00% by mass.

17. The aluminum alloy wire according to claim 1, wherein a diameter of a strand is 0.1 to 0.5 mm.

18. An aluminum alloy stranded wire obtained by stranding a plurality of the aluminum alloy wires according to claim 1.

19. A covered electric wire comprising a covering layer at an outer periphery of the aluminum alloy wire according to claim 1.

20. A wire harness comprising:

the covered electric wire according to claim 19; and a terminal fitted at an end portion of the covered electric wire, the covering layer being removed from the end portion.

* * * * *